US006955291B1

(12) United States Patent
Knight

(10) Patent No.: US 6,955,291 B1
(45) Date of Patent: Oct. 18, 2005

(54) ADJUSTABLE MAILBOX PLATFORM

(76) Inventor: Vincent Knight, P.O. Box 24557, Christiansted, VI (US) 00824

( * ) Notice: Subject to any disclaimer, the term of this patent is extended or adjusted under 35 U.S.C. 154(b) by 0 days.

(21) Appl. No.: 10/719,037

(22) Filed: Nov. 24, 2003

(51) Int. Cl.[7] ..... B65D 91/00
(52) U.S. Cl. ..... 232/39; 248/128; 248/424
(58) Field of Search ..... 232/39; 248/128, 248/424, 429, 218.4, 219.1, 219.2, 219.3, 248/219.4

(56) References Cited

U.S. PATENT DOCUMENTS

| | | | | |
|---|---|---|---|---|
| 1,094,529 A | | 4/1914 | Christensen | |
| 1,430,476 A | | 9/1922 | Trekell | |
| 1,731,682 A | | 10/1929 | Pendergrass | |
| 2,279,622 A | * | 4/1942 | Hurd | 248/145 |
| 2,611,570 A | * | 5/1952 | Kroll | 248/148 |
| 3,392,945 A | * | 7/1968 | Graham | 248/124.2 |
| 3,497,078 A | | 2/1970 | Nash | |
| 3,870,262 A | | 3/1975 | Manning, Jr. | |
| 4,113,213 A | * | 9/1978 | Gay et al. | 248/128 |
| 4,300,739 A | * | 11/1981 | Sande | 248/219.4 |
| 4,484,705 A | * | 11/1984 | Sande | 232/39 |
| 4,496,123 A | * | 1/1985 | Laramie | 248/121 |
| 4,821,952 A | | 4/1989 | Deciutiis | |
| 4,995,576 A | * | 2/1991 | Kieswetter | 248/145 |
| 5,425,501 A | | 6/1995 | Wesorick | |
| D376,464 S | | 12/1996 | Cunningham et al. | |
| 6,161,756 A | * | 12/2000 | Upton | 232/39 |
| 6,474,543 B2 | * | 11/2002 | Grell | 232/38 |

* cited by examiner

*Primary Examiner*—William L. Miller

(57) ABSTRACT

An adjustable mailbox platform is connectable to an existing mailbox post for receiving a mailbox thereon. The platform includes a bracket including a plurality of spaced side members for securing to a mailbox post. A plurality of cross members are secured to the side members for maintaining a stable position. The platform further includes an elongated support member with a flanged end portion for securely receiving a mailbox thereon. The support member includes a plurality of edge portions slidably engageable between the plurality of side members so the mailbox can be selectively moved between forward and rearward positions. The support member and cross members have a plurality of holes formed therein and alignable with each other for receiving a fastening member therethrough and for securely attaching the support member to the bracket.

6 Claims, 4 Drawing Sheets

ADJUSTABLE MAILBOX PLATFORM

STATEMENT REGARDING FEDERALLY SPONSORED RESEARCH OR DEVELOPMENT

Not Applicable

CROSS REFERENCE TO RELATED APPLICATIONS

Not Applicable

REFERENCE TO A MICROFICHE APPENDIX

Not Applicable

BACKGROUND OF THE INVENTION

1. Technical Field

This invention relates to mailboxes and, more particularly, to an adjustable mailbox platform for that can be extended and retracted to facilitate vehicular delivery of mail when snow has accumulated in front of the mailbox.

2. Prior Art

A problem that frequently arises in rural areas is that the delivery of mail becomes difficult, if not impossible, after a heavy snow because the mail carriers are unable to reach a customer's mailbox from their vehicles. This condition is aggravated when the roadway is plowed and snow is piled up between the roadway and the post upon which the mailbox is mounted. Often in such situations, the mail carrier cannot bring his vehicle sufficiently close to the mailbox to deliver the mail.

The United States Postal Service has promulgated regulations that require that rural mailboxes be placed where they can be safely and conveniently served by carriers from their vehicles and that customers remove all obstructions that make delivery difficult. This poses a particularly serious problem for elderly and infirm people who cannot physically remove the snow that prevents the mail carrier from delivering the mail. In many northern areas, the temperature may not rise above freezing for weeks, or even months, further prolonging the problem.

Many rural customers also rely upon the mail carrier to pick up their outgoing mail as well as deliver the incoming mail. Treacherous road conditions and long distances to the post office often require rural customers to give their outgoing mail to the mail carrier. This makes it equally important that outgoing mail be picked up so that a customer's bills can be paid and other correspondence sent out. Therefore, it is important for a mail carrier to be able to position his vehicle close enough to not only put the mail into the mailbox, but also to retrieve any outgoing mail.

Accordingly, a need remains for an adjustable mailbox platform that enables a user to extend the mailbox to a point where the mail carrier can easily access it, and then retract the mailbox when weather and road conditions permit.

BRIEF SUMMARY OF THE INVENTION

In view of the foregoing background, it is therefore an object of the present invention to provide an apparatus for selectively adjusting the length of a mailbox support. These and other objects, features, and advantages of the invention are provided by an adjustable mailbox platform connectable to an existing mailbox post and for receiving a mailbox thereon.

The platform includes a bracket with a plurality of spaced side members having substantially triangular shapes, respectively, and including inner surfaces secured to opposed sides of a mailbox post. The plurality of side members further include front and rear sides wherein a support member is selectively positionable therealong. The platform further includes a plurality of cross members having oppositely spaced edge portions secured to the plurality of side members, respectively, and for assisting to maintain same at substantially stable positions.

The platform further includes an elongated support member having a centrally disposed longitudinal axis and a plurality of opposed edge portions equally spaced therefrom and extending substantially parallel to the longitudinal axis along a length of the support member. The support member includes a flanged front-end portion with a top surface disposed above both the top surface of the support member and the plurality of cross members. Advantageously, a mailbox can be securely fastened to the flange portion without contacting the remaining portion of the support member or cross members. The support member further includes a plurality of edge portions slidably engageable between the plurality of side members so that a mailbox can be selectively moved between forward and rearward positions. The plurality of cross members and the support member have a plurality of holes formed therein, respectively, with select ones of same being alignable with each other for receiving a fastening member therethrough and to thereby securely attach the support member to the bracket.

BRIEF DESCRIPTION OF THE SEVERAL VIEWS OF THE DRAWING

The novel features believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

DETAILED DESCRIPTION OF THE INVENTION

Figure 1:
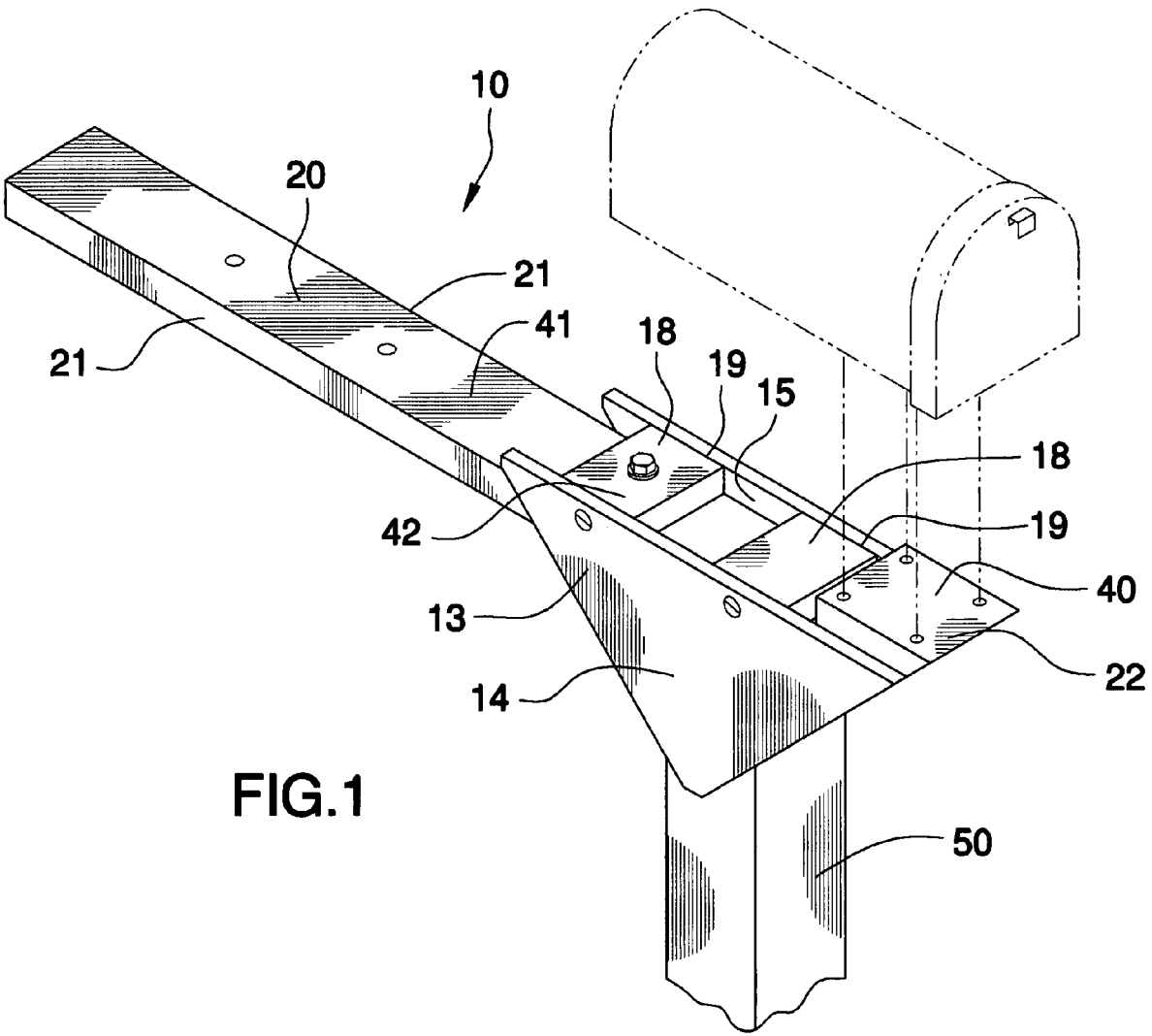
FIG. 1 is a perspective view showing an adjustable mailbox platform, in accordance with the present invention.
Figure 2:
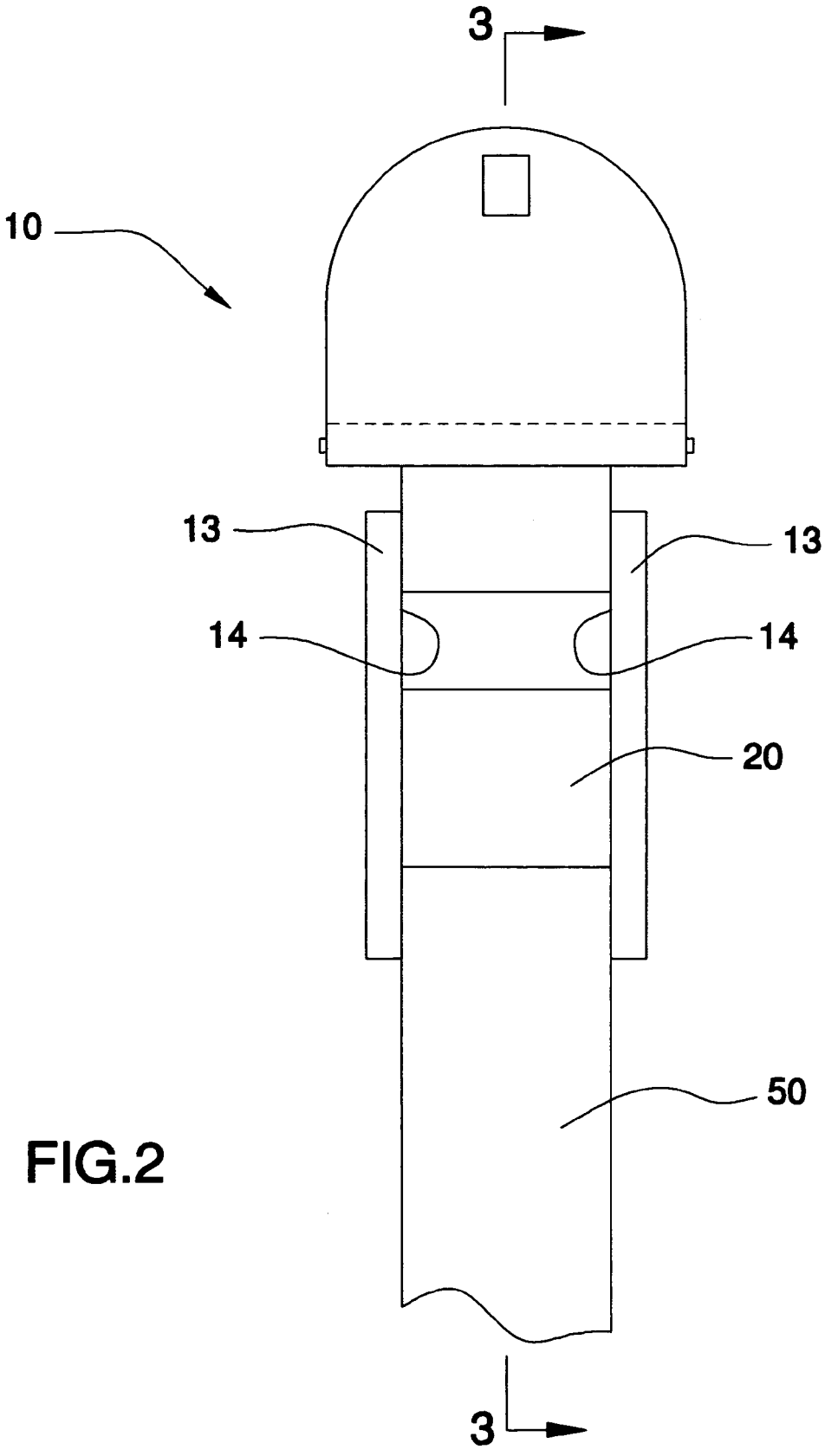
FIG. 2 is front elevational view of the adjustable mailbox platform shown in FIG. 1.

The present invention will now be described more fully hereinafter with reference to the accompanying drawings, in which a preferred embodiment of the invention is shown. This invention may, however, be embodied in many different forms and should not be construed as limited to the embodiment set forth herein. Rather, this embodiment is provided so that this application will be thorough and complete, and will fully convey the true scope of the invention to those skilled in the art.

The apparatus of this invention is referred to generally in FIGS. 1–4 by the reference numeral 10 and is intended to provide an adjustable mailbox platform connectable to an existing mailbox post and for receiving a mailbox thereon.

It should be understood that the platform 10 may be used to support, extend and retract many different types of storage containers and should not be limited to mailboxes.

Referring to FIG. 1, the platform 10 includes a bracket 13 with a plurality of spaced side members 14 including respective inner surfaces 15 secured to opposed sides of a mailbox post 50. Such side members 14 have substantially triangular shapes and, of course, may have alternate shapes suitable for their intended purpose, as well known in the art. For example, the side members 14 may have rectangular shapes without departing from the true scope of the present invention. The plurality of side members 14 include front and rear sides 16, respectively. The bracket 13 further includes a plurality of cross members 18 having oppositely spaced edge portions 19 secured to the plurality of side members 14, respectively, and for assisting to maintain same at substantially stable positions.

Still referring to FIG. 1, the platform 10 includes an elongated support member 20 having a centrally disposed longitudinal axis (not shown) and a plurality of opposed edge portions 21 equally spaced therefrom and extending substantially parallel to the longitudinal axis along a length of the support member 20. The support member 20 includes a flanged front-end portion 22 having a top surface 40 disposed above a top surface 41 of the support member 20. Such a top surface 40 is also disposed above a top surface 42 of the plurality of cross members 18. Advantageously, the flange member 22 is able to effectively support a mailbox thereon without contacting the remaining portion of the support member 20 or associated cross members 18.

Figure 3:
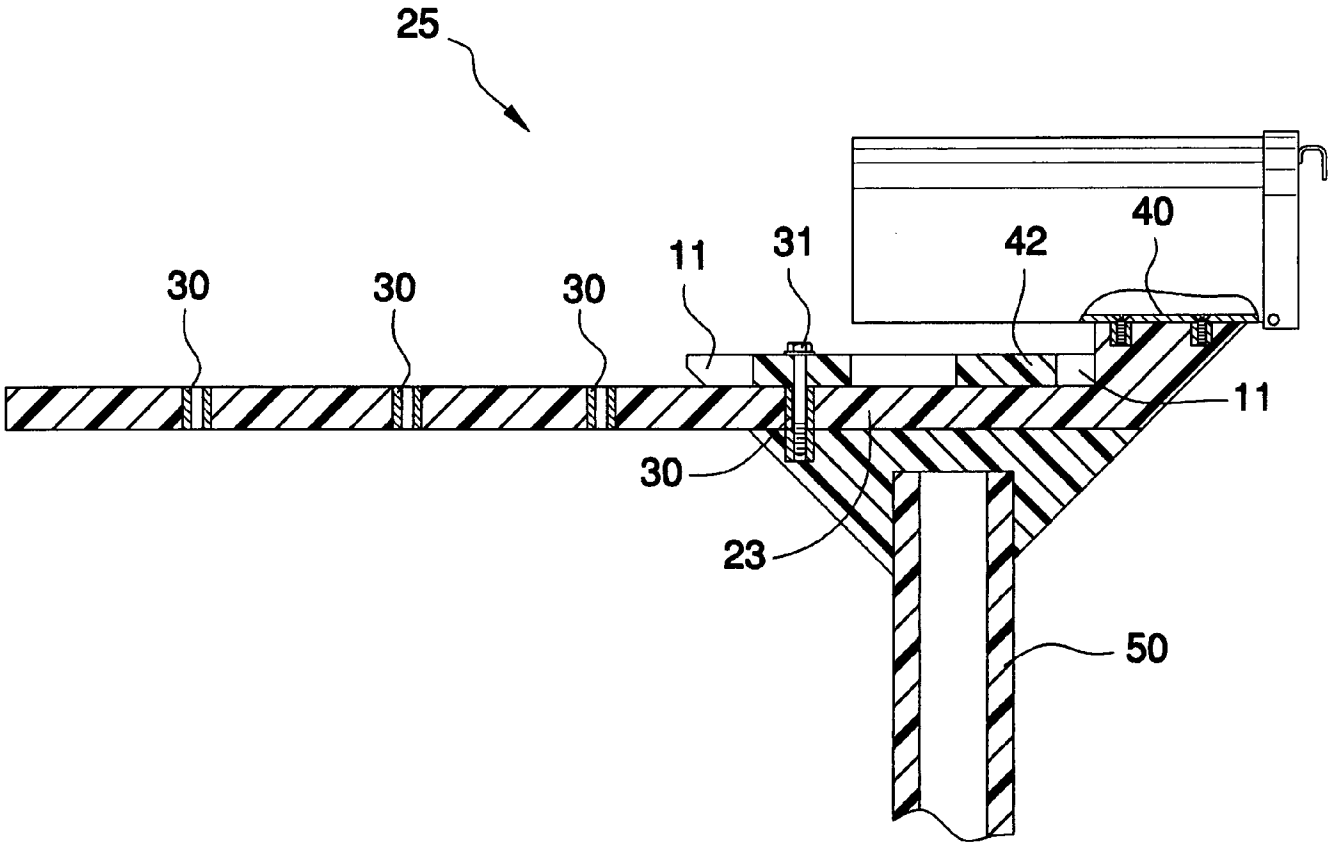
FIG. 3 is a side cross-sectional view of FIG. 1 and showing the adjustable mailbox platform at a retracted position.
Figure 4:
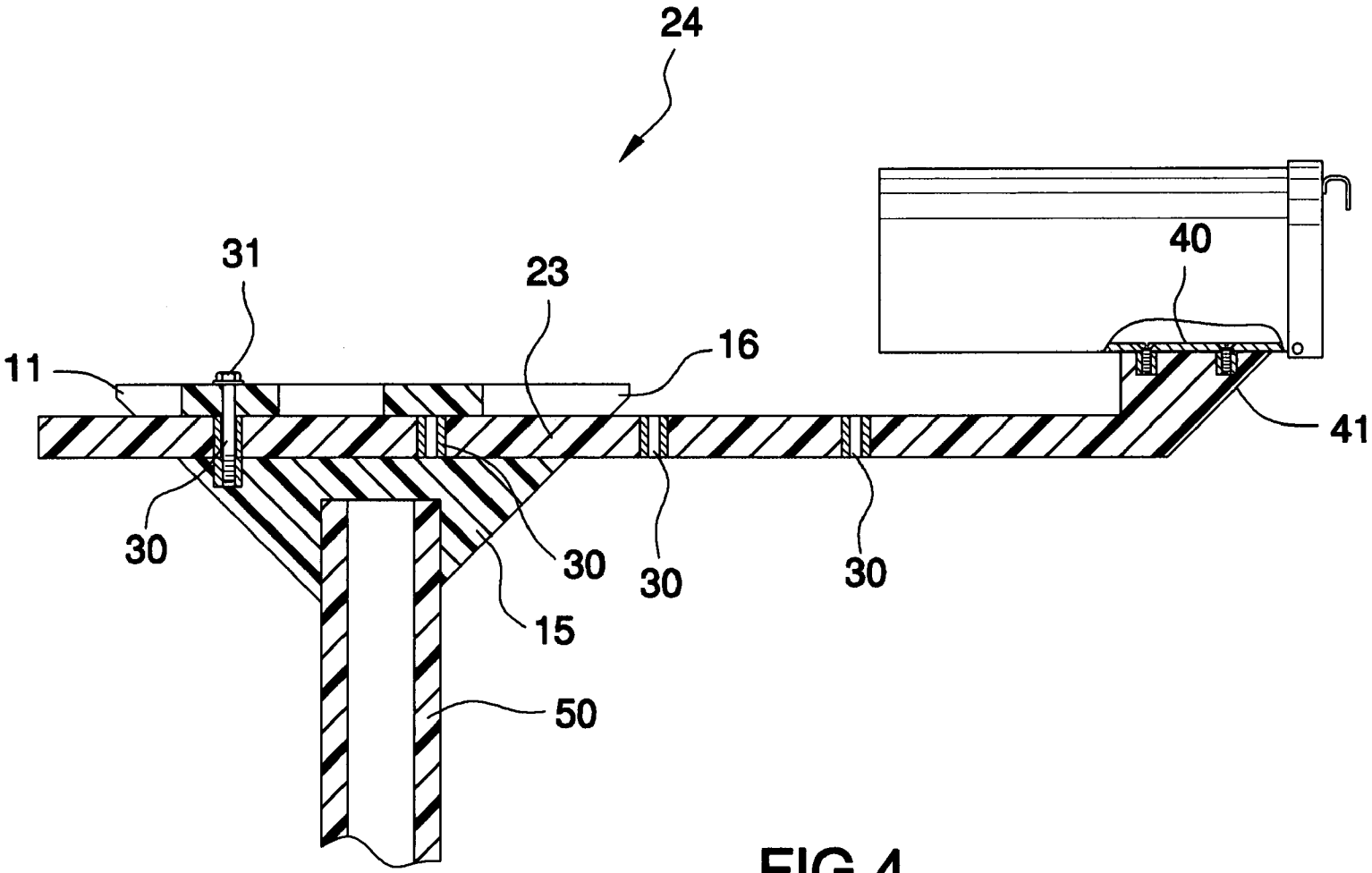
FIG. 4 is a side cross-sectional view of FIG. 1 and showing the adjustable mailbox platform at an extended position.

Now referring to FIGS. 3 and 4, the opposed edge portions 23 of the support member 20 are slidably engageable between the plurality of side members 14 and is thereby extendable substantially horizontally between the front and rear sides of the side members 14. Advantageously, this allows a user to selectively position the mailbox depending upon the amount of snow along the roadside, so that the mail carrier can easily access it without exiting his vehicle. The plurality of cross members 18 and the support member 20 have a plurality of holes 30 formed therein, respectively, and select ones of same are alignable with each other for receiving a corresponding fastening member 31 such as a conventional steel bolt, for example, therethrough so that the support member 20 will become securely attached to the bracket 13.

Because the Postal Service will not deliver mail to mailboxes blocked by snow, the platform 10 will allow mail carriers to deliver mail at all times and save the homeowner the time and expense of removing snow from in front of the mailbox. This is especially beneficial for elderly people and those with physical disabilities or limitations. The platform 10 is preferably formed of metal but could be formed of wood or durable plastic, as well known to a person of ordinary skill in the art.

While the invention has been described with respect to a certain specific embodiment, it will be appreciated that many modifications and changes may be made by those skilled in the art without departing from the spirit of the invention. It is intended, therefore, by the appended claims to cover all such modifications and changes as fall within the true spirit and scope of the invention.

In particular, with respect to the above description, it is to be realized that the optimum dimensional relationships for the parts of the present invention may include variations in size, materials, shape, form, function and manner of operation. The assembly and use of the present invention are deemed readily apparent and obvious to one skilled in the art.

What is claimed as new and what is desired to secure by Letters Patent of the United States is:

1. A mailbox support apparatus connectable to an existing mailbox post and for receiving a mailbox thereon, said apparatus comprising:

a bracket including a plurality of spaced side members including inner surfaces secured to opposed sides of a mailbox post, said plurality of side members including front and rear sides respectively, and a plurality of cross members having oppositely spaced edge portions secured to said plurality of side members respectively and for assisting to maintain said plurality of side members at stable positions; and an elongated support member having a centrally disposed longitudinal axis and a plurality of opposed edge portions equally spaced therefrom and extending substantially parallel to the longitudinal axis along a length of said support member, said support member including a flanged front end portion for securely receiving a mailbox thereon, said plurality of edge portions of said support member being slidably engageable between said plurality of side members so that a mailbox can be selectively moved between forward and rearward positions;

wherein said plurality of cross members and said support member have a plurality of holes formed therein respectively and select ones of said plurality of holes being alignable with each other for receiving a fastening member therethrough so that said support member will become securely attached to said bracket.

2. The apparatus of claim 1, wherein said plurality of side members are formed to be substantially triangular.

3. The apparatus of claim 1, wherein said flanged front-end portion includes a top surface disposed above a top surface of said support member.

4. A mailbox support apparatus connectable to an existing mailbox post and for receiving a mailbox thereon, said apparatus comprising:

a bracket including a plurality of spaced side members including inner surfaces secured to opposed sides of a mailbox post, said plurality of side members including front and rear sides respectively, and a plurality of cross members having oppositely spaced edge portions secured to said plurality of side members respectively and for assisting to maintain said plurality of side members at stable positions;

an elongated support member having a centrally disposed longitudinal axis and a plurality of opposed edge portions equally spaced therefrom and extending substantially parallel to the longitudinal axis along a length of said support member, said support member including a flanged front end portion for securely receiving a mailbox thereon, said plurality of edge portions of said support member being slidably engageable between said plurality of side members so that a mailbox can be selectively moved between forward and rearward positions, said flanged front end portion includes a top surface disposed above a top surface of said plurality of cross members; and said plurality of cross members and said support member have a plurality of holes formed therein respectively and select ones of said plurality of holes being alignable with each other for receiving a fastening member therethrough so that said support member will become securely attached to said bracket.

5. The apparatus of claim 4, wherein said plurality of side members are formed to be substantially triangular.

6. The apparatus of claim 4, wherein said flanged front-end portion top surface is disposed above a top surface of said support member.

* * * * *